US005574527A

United States Patent [19]

Folkins

[11] Patent Number: 5,574,527

[45] Date of Patent: Nov. 12, 1996

[54] MULTIPLE USE OF A SENSOR IN A PRINTING MACHINE

[75] Inventor: Jeffrey J. Folkins, Rochester, N.Y.

[73] Assignee: Xerox Corporation, Stamford, Conn.

[21] Appl. No.: 533,036

[22] Filed: Sep. 25, 1995

[51] Int. Cl.[6] ..... G03G 21/00

[52] U.S. Cl. ..... 399/9; 399/30; 399/58; 399/372; 399/381

[58] Field of Search ..... 355/203, 208, 355/246, 327, 311, 317; 347/116

[56] References Cited

U.S. PATENT DOCUMENTS

| | | | |
|---|---|---|---|
| 4,239,372 | 12/1980 | Iwai | 355/246 |
| 4,318,610 | 3/1982 | Grace | 355/246 |
| 4,348,099 | 9/1982 | Fantozzi | 355/208 |
| 4,505,572 | 3/1985 | Ashida et al. | 355/246 |
| 4,660,059 | 4/1987 | O'Brien | 347/115 |
| 4,989,985 | 2/1991 | Hubble, III et al. | 356/445 |
| 5,101,232 | 3/1992 | Evans et al. | 355/208 |
| 5,139,339 | 8/1992 | Courtney et al. | 356/446 |
| 5,173,733 | 12/1992 | Green | 355/208 |
| 5,266,997 | 11/1993 | Nakane et al. | 355/208 |
| 5,291,245 | 3/1994 | Charnitski et al. | 355/208 |
| 5,315,351 | 5/1994 | Matsushiro et al. | 355/246 |
| 5,329,338 | 7/1994 | Merz et al. | 355/207 |
| 5,343,282 | 8/1994 | Kazaki et al. | 355/208 X |
| 5,402,222 | 3/1995 | Haneda et al. | 355/327 |
| 5,410,388 | 4/1995 | Pacer et al. | 355/208 |
| 5,457,518 | 10/1995 | Ashikaga et al. | 355/208 |
| 5,519,497 | 5/1996 | Hubble, III et al. | 356/445 |

FOREIGN PATENT DOCUMENTS

| | | |
|---|---|---|
| 60-86574 | 5/1985 | Japan . |
| 4-67172 | 3/1992 | Japan . |

OTHER PUBLICATIONS

U.S. patent application Ser. No. 08/451,609 filed May 26, 1995 Title: "Wide Area Beam Sensing Method and Apparatus for Image Registration Calibration in a Color Printer".

*Primary Examiner*—Arthur T. Grimley
*Assistant Examiner*—Sophia S. Chen

[57] ABSTRACT

A method and apparatus for sensing multiple process parameters with a single sensor in a printing machine. The sensor senses the photoreceptor belt seam to insure that the latent image is not formed on the belt seam; the toner density is used to control the toner dispenser, photoreceptor charging, developer bias, image exposure and image processing systems; registration marks which are used to control registration of multiple images; presence of copysheets in a paper transport which is used to indicate timing and paper jams or faults; and copysheet type which is used to control the fusing process time. In order to measure all of these parameters, the sensor is uniquely located in printing parameter sensing relationship to the photoreceptor and along the paper path of the printing machine.

20 Claims, 3 Drawing Sheets

MULTIPLE USE OF A SENSOR IN A PRINTING MACHINE

This invention relates generally to an electrophotographic printing machine, and more particularly concerns a multiple use optical sensor located in a unique position adjacent to the photoreceptor and the paper path and which measures a variety of system performance parameters for control to the printing process.

It is well known to have separate sensors measure various process parameters of the electrophotographic printing process for process control feedback purposes. For example, optical sensors are used to measure the toner density of developed images, this measurement being used in inferring the electrostatics of the photoreceptor; to detect registration marks which are compared for proper registration of multiple images; to detect a photoconductor belt seam or mark to insure proper placement of the latent image on the belt; to detect the presence of a copysheet at the sensor which is used to verify the correct paper transit timing and to determine if a jam or fault has occurred; and to detect the difference between an opaque and transparent copysheet so that the proper fusing time or other related process variables may be set. In low volume desktop printing machines, it is desirable to reduce the size and cost of the printing machine. This can be accomplished by having a single sensor, for example an infrared densitometer (IRD), measure all of these printing parameters and relay the information to a process controller which in turn controls all of the above mentioned printing processes.

The following disclosures may be relevant to various aspects of the present invention:

U.S. Pat. No. 4,989,985

Patentee: Hubble, III et al.

Issued. Feb. 5, 1991

U.S. Pat. No. 4,660,059

Patentee: O'Brien

Issued: Apr. 21, 1987

U.S. Pat. No. 4,318,610

Patentee: Grace

Issued: Mar. 9, 1982

U.S. Pat. No. 4,239,372

Patentee: Iwai

Issued: Dec. 16, 1980

U.S. Pat. No. 4,505,572

Patentee: Ashida et al.

Issued: Mar. 19, 1985

U.S. Pat. No. 5, 139,339

Patentee: Courtney et al.

Issued: Aug. 18, 1992

U.S. Pat. No. 5,329,338

Patentee: Merz et al.

Issued: Jul. 12, 1994

U.S. Pat. No. 5,101,232

Patentee: Evans et al.

Issued: Mar. 31, 1992

U.S. Pat. No. 5,291,245

Patentee: Charnitski et al.

Issued: Mar. 1, 1994

U.S. Pat. No. 4,348,099

Patentee: Fantozzi

Issued Sep. 7, 1982

The relevant portions of the foregoing disclosures may be briefly summarized as follows:

U.S. Pat. No. 4,989,985 discloses a color electrophotographic printing machine with an infrared densitometer (IRD) used to detect a reduction in the specular reflectivity as toner particles are progressively deposited on a photoconductive member. The densitometer measures the developabiity of the the latent image which is used to regulate the amount of toner used in the development process.

U.S. Pat. No. 4,318,610 teaches controlling the toner particle concentration within a developer mixture and the charge of the photoconductive surface. A first test area and a second test area are recorded on the photoconductive surface. An infrared densitometer detects the density of the developed test areas and produces electrical output signals to a controller. The concentration of toner particles within the developer mixture is controlled in response to the toner particle density of the first test area. Charging of the photoconductive surface is regulated in response to the toner particle density of the second test area.

U.S. Pat. No. 4,239,372 teaches a copying machine which detects toner density and a non-stripped unseparated transfer sheet with a single combination of a light projecting element and a light receiving element. The amount of toner supplied is controlled in accordance with the voltage developed by the reflection of light from an indexing image developed on the photosensitive member, the same reflected light also detecting the presence of an unseparated transfer sheet.

U.S. Pat. No. 4,505,572 discloses a sensor unit in an electrostatic reproducing apparatus which is capable of sensing the concentration of toner and the jamming of non-stripped unseparated sheets of recording paper after image transfer. The sensor unit is a light emitting element and a light receiving element disposed close to the surface of a photosensitive member at a position downstream of the position where the printed sheet of recording paper separates from the photosensitive member. One of the light emitting elements is a visible-light emitting diode used for detecting jamming of the sheet of recording paper and the other light emitting element is an infrared-light emitting diode used for detecting the toner concentration.

U.S. Pat. No. 5,139,339 discloses a media discriminating and presence sensor that can detect and discriminate between paper and transparencies using a light emitting diode and two detectors configured to measure both diffuse and specular reflectivity of the media. Opaque papers reflect light diffusely and transparencies reflect light specularly. These measurements are used to discriminate between the two types of copysheets.

U.S. Pat. No. 5,329,338 teaches detecting and discriminating a copysheet in an electronic reprographic printing system. A diffuse reflective sensor is located adjacent to the path over which the copy sheet moves. The sensor is disposed so that its optical axis intersects the copy sheet where the angle of intersection between the copysheet and the optical axis remains within a specified range of angles for the maximum length of the copy sheet. Another jam detection sensor is disposed along inlet baffles of a paper path and is used to detect both opaque and transparent copysheets. A distinguishing sensor is also disposed adjacent copysheet inlet baffles with its optical axis aligned so that a transparent copysheet is not detected while an opaque copy sheet is detected.

U.S. Pat. No. 4,657,369 teaches an electrostatic copying machine comprising an internal computer system which regulates the movement of an endless photoconductive belt based on signals received by a photosensing device which coordinates the position of a photoconductive belt based on the passage and detection of a single notch punched into the belt. The notch is placed at a predetermined distance from the belt seam and is detected by a photosensor. This information allows the machine belt drive system to avoid placing an image onto the belt seam during the copying process.

U.S. Pat. No. 5,101,232 discloses controlling the velocity of the photoreceptor within a multiple image reprographic machine having a seamed, web-type photoreceptor. To avoid having a seam of the belt within a latent image, the position or velocity of the belt is controlled by having an optoelectronic sensor detect a timing or belt hole. The belt sensor is coordinated with a registration sensor to adjust the speed of the belt.

U.S. Pat. No. 5,291,245 discloses a sensor positioned on one side of a photoreceptor belt in opposed relationship to a light source which is used to detect the seam in the photoreceptor belt. When the seam passes between the light source and the sensor a characteristic output signal is created and recognized by the system software which controls imager operation to ensure that latent images are not formed across the seam. The same belt seam sensor may also be used to detect developed toner marks on the photoreceptor, which are used to register successive images.

U.S. Pat. No. 4,348,099 teaches a sample data control system with a charge control loop, an illumination control loop, a toner dispensing control loop, and a bias control loop. Two test targets, each having two test patches are selectively exposed in various combinations to provide test data in the photoreceptor image area for suitable sensing and control of the charge, illumination, toner dispensing, and bias control loops.

The following are two pending patent applications, which are assigned to the same assignee as this patent application, which disclose potentially relevant information:

U.S. patent application Ser. No. 08/345,037, now U.S. Pat. No 5,519,497, filed Nov. 25, 1994 entitled "Control Development Mass in a Color System" discloses an enhanced toner area coverage (ETAC) sensor. In the operation of this densitometer, collimated light rays are projected onto a test patch including marking particles which are progressively deposited on a moving photoconductive belt. The light rays reflected from the test patch are collected and directed onto a photodiode array. The photodiode array generates electrical signals proportional to the total flux and a diffuse component of the total flux of the reflected light rays. Circuitry compares the electrical signals and determines the difference to generate an electrical signal proportional to the specular component of the total flux of the reflected light rays. Additional circuitry adds the electrical signals proportional to the total flux and the diffuse component of the total flux of the reflected light rays and compares the result of the summed signal to the specular component to provide a total diffuse signal for controlling developed mass.

U.S. patent application Ser. No. 08/451,609 filed on May 26, 1995, entitled "Wide Area Beam Sensing Method and Apparatus for Image Registration Calibration in a Color Printer" discloses using a wide area beam sensor to detect image registration calibration in a full color printing machine without requiring precise timing measurements. This is accomplished by moving a photoreceptor through a printing cycle so that sets of multiple black toner registration marks are formed on different areas of the photoreceptor and second sets of multiple nonblack toner registration marks are formed on the photoreceptor corresponding respectively to the black marks in each set of the first sets of black marks so that a series of sets of multicolor registrations marks are created. A light source for producing a wide area beam (WAB) illuminates each set of the series of sets of multicolor marks and the WAB sensor measures the scattered or diffuse light reflected from each set of the illuminated sets of multicolor marks, producing an actual light reflectance measurement value from each illuminated set. The printer has a comparing device for determining the degree of actual image misregistration by comparing each of the actual light reflectance measurement values with the stored predetermined registration offset value corresponding to a predetermined condition of image misregistration for each illuminated set of multicolor marks All of the above references are hereby incorporated by reference.

SUMMARY OF THE INVENTION

In accordance with one aspect of the present invention, there is provided a method of sensing process parameters and controlling the printing process in a printing machine. The method includes passing a charge retentive surface through at least one revolution about the printing machine; forming a latent image on the charge retentive surface during the revolution; developing the latent image with toner; transporting a transfer sheet along a paper path; transferring the developed image to the transfer sheet; fusing the transferred image to the transfer sheet; locating an optoelectronic sensor in sensing relationship with the charge retentive surface and the paper path; sensing a printing parameter with the optoelectronic sensor; and controlling the printing process based on the sensed printing parameter.

Pursuant to another aspect of the present invention, there is provided an apparatus for sensing process parameters and controlling the printing process in a printing machine. The apparatus includes means for passing a charge retentive surface through the printing machine; means for forming a latent image on the charge retentive surface; means for developing the latent image with toner; means for transferring the developed image to a transfer sheet; means for fusing the transferred image to the transfer sheet; an opto-electronic sensor for sensing a printing parameter located in sensing relationship with the charge retentive surface and the paper path; and a controller for controlling the printing process based on the sensed printing parameter.

Still another aspect of the invention deals with a printing machine including a charge retentive surface; image forming means for forming a latent image on the charge retentive surface; developing means for developing the latent image with toner; transfer means for transferring the developed toner image from the charge retentive surface to a support surface; and a control arrangement responsive to a printer parameter sensor for controlling operation of the printing machine. A sensor is mounted in printer parameter sensing relationship to at least the charge retentive surface and a portion of a support surface transport path and senses a plurality of printing parameters thereat. There is also a means responsive to the sensor, which controls adjustment of a plurality of sensed printer parameters.

The present invention's multiple use of a sensor results in a lower cost for components and less space necessary to house the components. These results are especially desirable in low cost desktop printing machines.

Other features of the present invention will become apparent as the following description proceeds and upon reference to the drawings, in which:

FIG. 1 schematically illustrates a 5-cycle color electrophotographic printing machine;

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION

The preferred embodiment of the invention described in this application is a five pass printing machine architecture, however, the multiple use IRD can also be used in conventional single pass and other multipass printing machines, the IRD's operation and thus the sensing and controlling operations changing depending upon the printing architecture used. Patent application Ser. No. 08/477,013 entitled "Five Cycle Image on Image Printing Architecture", filed on Jun. 7, 1995 and assigned to the same assignee describes in detail a five cycle printing machine in which the present multiple-use sensor invention may operate. This patent application is hereby incorporated by reference. Below is a general description of the five cycle architecture.

Figure 1:
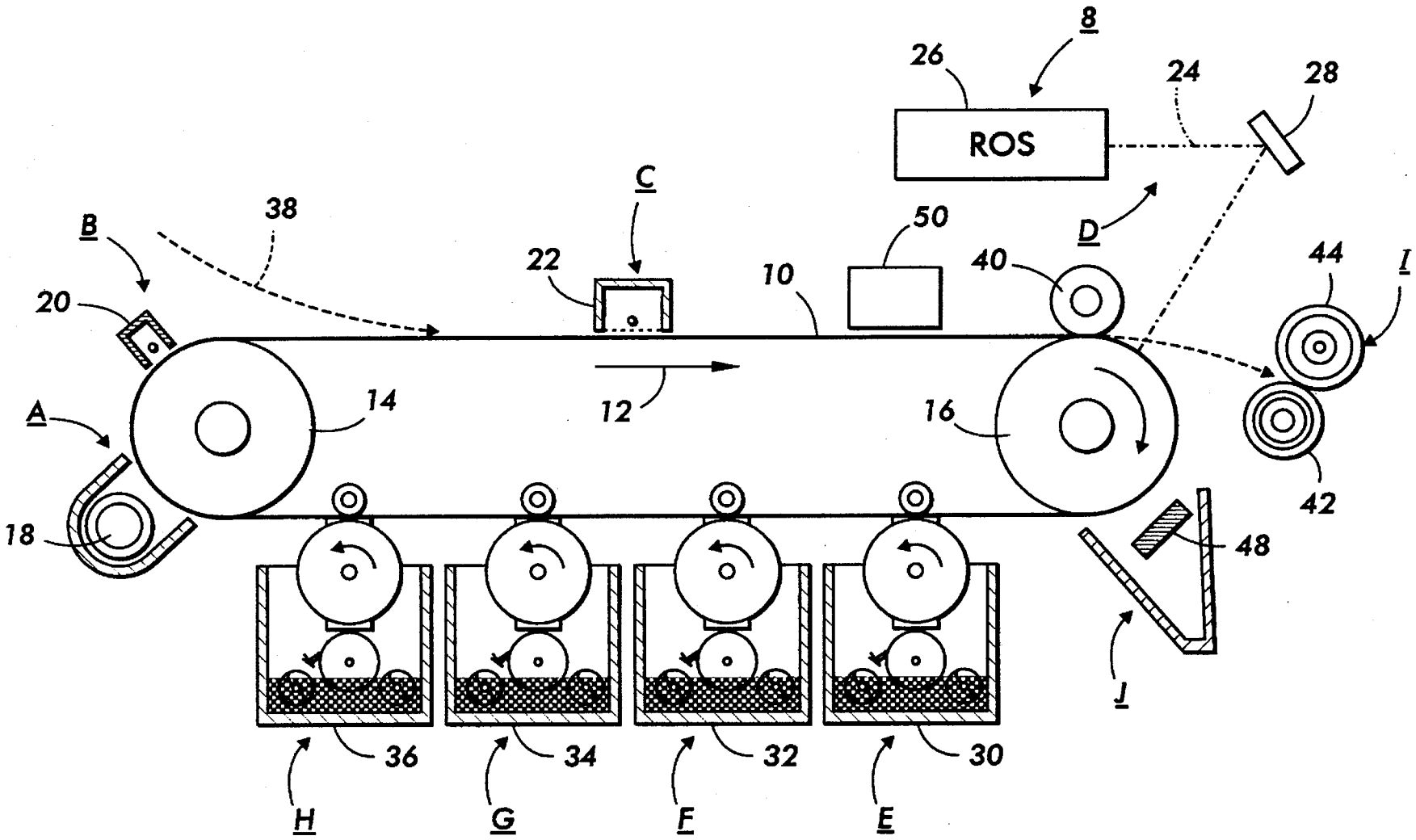

The embodiment shown in FIG. 1 includes a plurality of individual subsystems which are well known in the prior art but which are organized and used so as to produce a color image in 5 cycles, or passes, of a photoconductive member. While the 5 cycle color electrophotographic architecture results in a 20% loss of productivity over a comparable 4 cycle color electrophotographic architecture, the additional cycle allows for a significant size and cost reduction.

FIG. 1 illustrates a color electrophotographic printing machine 8 which is suitable for implementing the principles of the present invention. The printing machine 8 includes a photoreceptor belt 10 which travels in the direction indicated by the arrow 12. Belt travel is brought about by mounting the belt about a drive roller 16 (which is driven by a motor which is not shown) and a tension roller 14.

As the photoreceptor belt travels each part of it passes through each of the subsequently described process stations. For convenience, a single section of the photoreceptor belt, referred to as the image area, is identified. The image area is that part of the photoreceptor belt which is to receive the toner images which, after being transferred to a substrate, produce the final color image. While the photoreceptor belt may have numerous image areas, since each image area is processed in the same way a description of the processing of one image area suffices to fully explain the operation of the printing machine.

As previously mentioned, the production of a complete color print takes place in 5 cycles. The first cycle begins with the image area passing through an erase station A. At the erase station an erase lamp 18 illuminates the image area so as to cause any residual charge which exist on the image area to be discharged. Such erase lamps and their use in erase stations are well known. Light emitting diodes are commonly used as erase lamps.

As the photoreceptor belt continues its travel the image area passes through a first charging station B. At the first charging station B a corona generating device 20, beneficially a DC pin scorotron, charges the image area to a relatively high and substantially uniform potential of, for example, about −700 volts. After passing the corona generating device 20 the image area passes through a second charging station C which partially discharges the image area to about, for example −500 volts. The second charging station C includes an AC scorotron 22.

The use of a first charging station to overcharge the image area and a subsequent second charging station to neutralize the overcharge is referred to as split charging. Since split charging is beneficial for recharging a photoreceptor which already has a developed toner layer, and since the image area does not have such a toner layer during the first cycle, split charging is not required during the first cycle. If split charging is not used either the corona generating device 20 or the scorotron 22 corona could be used to simply charge the image area to the desired level of −500 volts. Split charging is described in more detail below After passing through the second charging station C the now charged image area passes through an exposure station D. At the exposure station D the charged image area is exposed to the output 24 of a laser based output scanning device 26 and which reflects from a mirror 28. During the first cycle the output 24 illuminates the image area with a light representation of a first color (say black) image. That light representation discharges some parts of the image area so as to create an electrostatic latent image. For example, illuminated sections of the image area might be discharged by the output 24 to about −50 volts. Thus after exposure the image area has a voltage profile comprised of relatively high voltages of about −500 volts and of relatively low voltages of about −50 volts.

After passing through the exposure station D the exposed image area passes through a first development station E which deposits a first color of negatively charged toner 30, preferably black, onto the image area. Toner adhering to the image area is charged This causes the voltage in the illuminated area to increase by about −200 volts. Thus after development the toned parts of the image area are charged to about −250 volts while the untoned parts are charged to about 500 volts.

The developer stations could be magnetic brush developer stations, however they are preferable scavengeless developers. A benefit of scavengeless development is that it does not disturb previously developed toner layers.

After passing through the first development station E, the image area advances so as to return to the first charging station B. The second cycle begins. The first charging station B uses its corona generating device 20 to overcharge the image area and its first toner layer to more negative voltage levels than that which the image area and its first toner layer are to have when they are exposed. For example, the untoned parts of the image area may be charged to a potential of about −700 volts.

The voltage differences between the toned and untoned parts of the image area are substantially reduced at the second charging station C. There the AC scorotron 22 reduces the negative charge on the image area by applying positive ions so as to charge the image area to about −500 volts.

An advantage of using an AC scorotron at the second charging station is that it has a high operating slope: a small voltage variation on the image area can result in large charging currents being applied to the image area. Beneficially, the voltage applied to the metallic grid of the AC scorotron 22 can be used to control the voltage at which charging currents are supplied to the image area. A disadvantage of using an AC scorotron is that it, like other AC operated charging devices, tends to generate much more ozone than comparable DC operated charging devices.

After passing through the second charging station C the now substantially uniformly charged image area with its first toner layer advances to the exposure station D. At the exposure station D the recharged image area is again exposed to the output 24 of a laser based output scanning device 26. During this pass the scanning device 26 illuminates the image area with a light representation of a second color (say yellow) image. That light representation discharges some parts of the image area so as to create a second electrostatic latent image. The potentials on the image area after it passes through the exposure station D the second time have a potential about −500. However, the illuminated areas, both the previously toned areas and the untoned areas are discharged to about −50 volts.

After passing through the exposure station D the now exposed image area passes through a second development station F which deposits a second color of toner 32, yellow, onto the image area. The second development station F preferably is a scavengeless developer.

After passing through the second development station F the image area and its two toner layers returns to the first charging station B. The third cycle begins. The first charging station B again uses its corona generating device 20 to overcharge the image area and its two toner layers to more negative voltage levels than that which the image area and its two toner layer are to have when they are exposed. The second charging station C again reduces the image area potentials to about −500 volts. The substantially uniformly charged image area with its two toner layers then advances again to the exposure station D. At exposure station D the image area is again exposed to the output 24 of the laser based output scanning device 26. During this pass the scanning device 26 illuminates the image area with a light representation of a third color (say magenta) image. That light representation discharges some parts of the image area so as to create a third electrostatic latent image.

After passing through the exposure station D the third time the image area passes through a third development station G. The third development station G, preferably a scavengeless developer, advances a third color of toner 34, magenta, onto the image area. The result is a third toner layer on the image area.

The image area with its three toner layers then advances back to the charging station B. The fourth cycle begins. The first charging station B once again uses its corona generating device 20 to overcharge the image area (and its three toner layers) to more negative voltage levels than that which the image area is to have when it is exposed (say about −500 volts). The second charging station C once again reduces the image area potentials to about −500 volts. The substantially uniformly charged image area with its three toner layers then advances yet again to the exposure station D. At the exposure station D the recharged image area is again exposed to the output 24 of the laser based output scanning device 26. During this pass the scanning device 26 illuminates the image area with a light representation of a fourth color (say cyan) image. That light representation discharges some parts of the image area so as to create a fourth electrostatic latent image.

After passing through the exposure station D the fourth time the image area passes through a fourth development station H. The fourth development station, also a scavengeless developer, advances a fourth color of toner 36, cyan, onto the image area. This marks the end of the fourth cycle.

After completing the fourth cycle the image area has four toner powder images which make up a composite color powder image. The fifth cycle begins with the image area passing the erase station A. At erase station A the erase lamp 18 discharges the image area to a relatively low voltage level. The image area with its composite color powder image then passes to the charging station B. During the fifth cycle the charging station B acts like a pre-transfer charging device by spraying the image area with negative ions. As the image area continues in its travel a substrate 38 is advanced into place over the image area using a sheet feeder (which is not shown). As the image area and substrate continue their travel they pass through station C.

At station C positive ions are applied by the scorotron 22 onto one side of the substrate 38. This attracts the charged toner particles from the image area onto the substrate. As the substrate continues its travel the substrate passes a bias transfer roll 40 which assists in separating the substrate and the composite color powder image from the photoreceptor belt 10. The substrate is then directed into a fuser station I where a heated fuser roll 42 and a heated pressure roller 44 create a nip through which the substrate passes. The combination of pressure and heat at the nip causes the composite color toner image to fuse into the substrate 38. After fusing a chute, not shown, guides the support sheets 38 to a catch tray, also not shown, for removal by an operator.

After the substrate is pulled off the photoreceptor belt 10 by the bias transfer roll 40 the image area continues its travel and eventually enters a cleaning station J. At cleaning station J a cleaning blade 48 is brought into contact with the image area. The cleaning blade wipes residual toner particles from the image area. The image area then passes once again to the erase station A and the 5 cycle printing process begins again.

The various machine functions described above are generally managed and regulated by a controller which provides electrical command signals for controlling the operations described above. The controller must have information from the printing process parameters in order to accurately control the printing process. In the present invention a single sensing device provides the controller with all of the necessary process parameter information.

In FIG. 1, a sensor 50, preferably an infrared densitometer (IRD) in the form of an enhanced toner area coverage (ETAC) sensor, is positioned after the second charging station C, adjacent the photoreceptor 10 and along the paper path 38. The sensor is used to detect the specular and diffuse components of the reflected light rays, a preferred IRD configuration and operation being disclosed in U.S. Ser. No. 08/345,037 as previously described. In the present invention, the IRD measurements are used to control multiple processes of the printing operation including controlling the toner dispenser, electrostatically controlling the photoreceptor, calibrating image registration, placing the latent image relative to the photoconductor belt seam, detecting faults or jams in the paper path, ascertaining paper path timing, setting fuser setpoints, developer biasing, image exposure and image processing. Below follows a discussion as to how the multiple uses of the IRD may be implemented.

The first printing parameter to be addressed is toner density. It is well known to use developed toner particle test areas on a photoreceptor to detect toner density. U.S. Pat. No. 4,318,610 teaches two test areas for toner particle density detection: a first test area used to control the developer mixture so that the proper concentration of toner particles is obtained and a second test area used to regulate the charging of the photoconductive surface.

Figure 2:
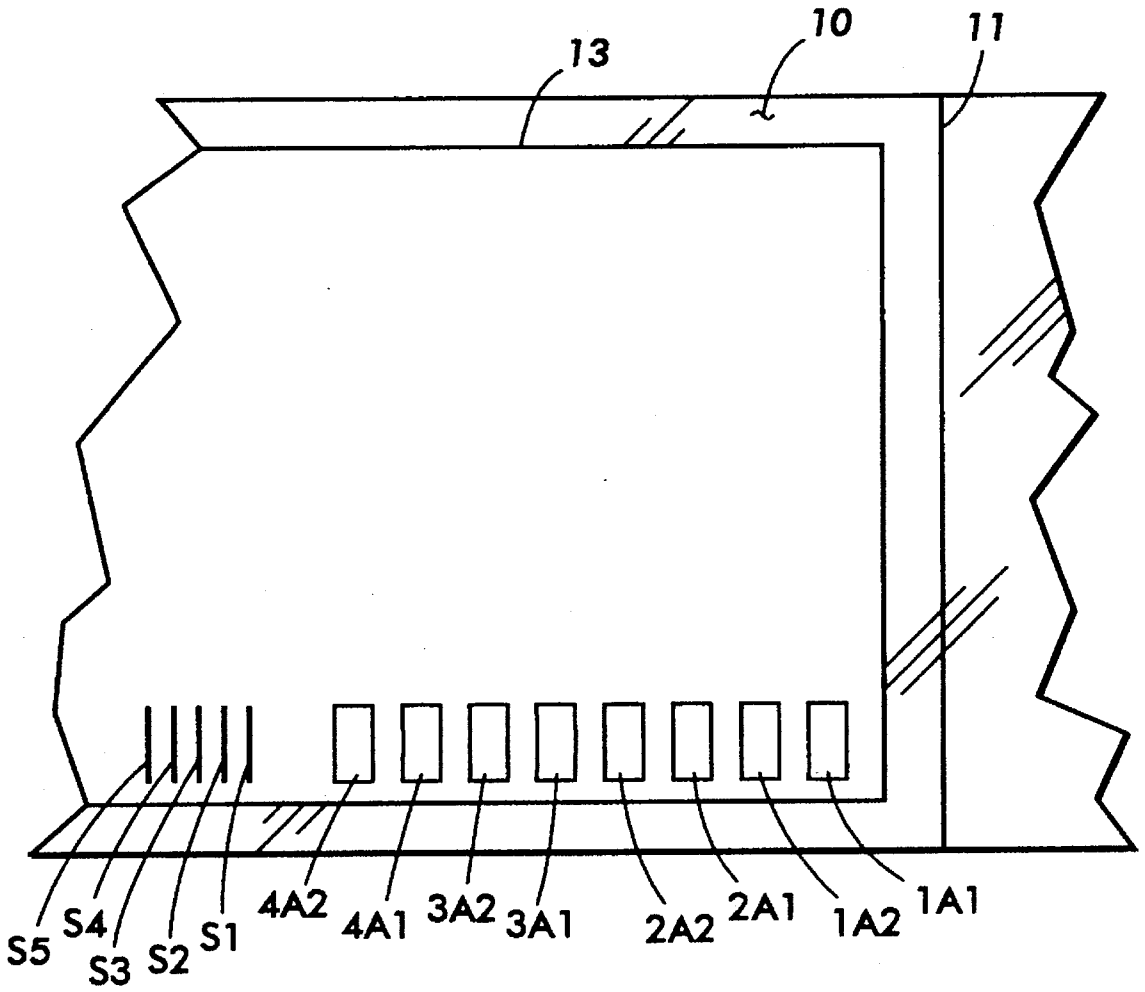
FIG. 2 is a plan view of the photoreceptor belt shown in FIG. 1.

In the embodiment shown in FIG. 2, test areas are formed on the previously charged photoreceptor 10 at exposure station D to form the latent image. FIG. 2 shows two test areas formed on the photoreceptor for each color to be imaged and developed; for example, 1A1 and 1A2 for black, 2A1 and 2A2 for yellow, 3A1 and 3A2 for magenta, and 4A1 and 4A2 for cyan. Only two test areas for all of the colors may also be used, in which case a separate test imaging cycle with only one color being developed and sensed per cycle is used.

The measurements of toner density 51 of each test area are made after a pass where toner has been developed. The sensor 50 detects the diffuse and the specular component of the reflected light from each test area. The toner density measurements are converted into an electrical signal proportional to the developed toner mass of the test areas. These signals are conveyed to the controller 60 for suitable processing.

Figure 3:
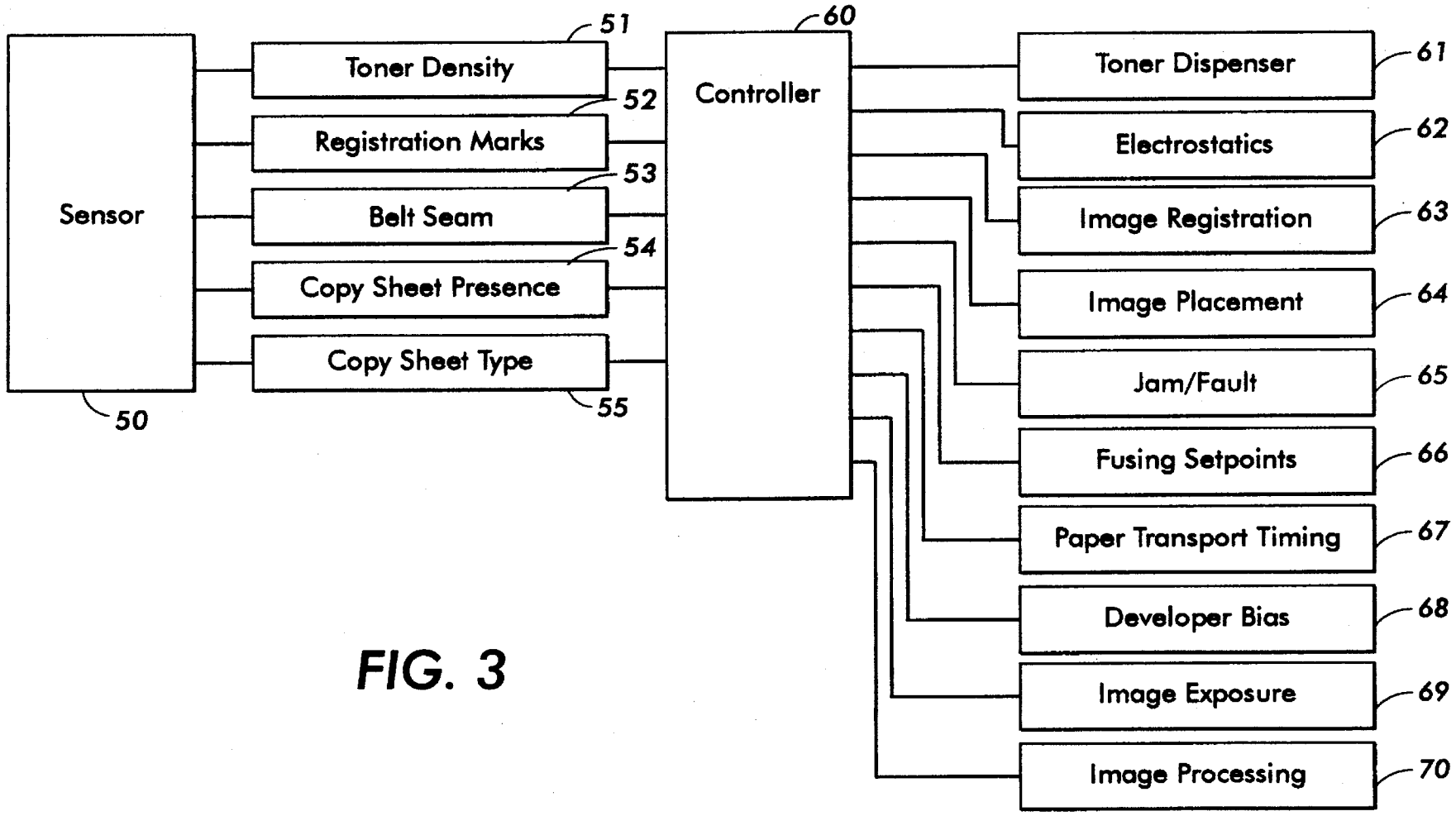
FIG. 3 is a schematic representation of the inputs and outputs of the process control system.

With reference to FIG. 3, in response to signals from test areas 1A1, 2A1, 3A1 and 4A1, the controller 60 controls the toner dispenser 61 at each developing station depending upon the desired toner concentration or developability for each respective color developer. The signals from test areas 1A2, 2A2, 3A2 and 4A2 are used by the controller 60 to control the electrostatic systems 62, the developer housing voltage bias system 68, the image exposure system 69, and the image processing system 70. The electrostatic system 62 is controlled by adjusting the power supply to charging stations B and C to control the charge applied to the photoreceptor 10. The developer bias system 68 is controlled by adjusting the various AC and DC power supplies (not shown) to development stations E, F, G and H. The image exposure system is controlled by adjusting the intensity of the exposure level of station D output scanner during the time period corresponding to the imaging of the corresponding color image registration. The image processing system 70 is controlled by adjusting the digital mapping between the input continuous tone or half-toned image values and the corresponding output digital or output scanner pulse width time values.

In the embodiment shown in FIG. 2, the test areas are located in the imaging area of the photoreceptor. This embodiment also has a one pitch belt which means that the belt is sized so that only one document in a document image zone 13 is imaged per rotation of the photoreceptor 10. It is well-known to have multiple pitch belts on which more than one document may be imaged. In multiple pitch belts there is an inter-document zone between the document imaging areas. The test areas may be located in the interdocument areas of the multiple pitch belts, rather than in the imaging area so that a separate test cycle is not necessary.

Since the test areas are located in the imaging area of the photoreceptor, the sensing of the test areas will need to occur in a cycle separate from an image processing cycle. The test areas can initially be sensed in a cycle-up or cycle-out performed at the end of the previous job and later sensed after a specified number of cycles during the printing process. The test imaging cycle in the embodiment shown would use n+1 passes, where n is the number of colors to be developed. It is important to note that no transfer sheet is introduced in the test imaging cycle so that the color developed in the next-to-last pass can be sensed in the last pass. In the five-pass architecture shown in FIG. 1, the test imaging cycle would include five passes of the photoreceptor, the test areas being sensed in the second, third, fourth and fifth passes.

Variations on the operations of the patch density measurement scheme can be made to generalize the algorithm of controller 60 to allow the control of toner dispenser system 61 to be dependent on both groups of patches A1 and A2 as well as other functional inputs such as permeability, toner concentration sensors, image bit or pixel counting information and other toner concentration and developability control techniques common in the art. Additionally, the control of the electrostatic system 62, developer bias system 68, image exposure system 69 and image processing system 70 could also be dependent on a more generalized input of both groups of patches A 1 and A2. An additional variation is that multiple patches of different densities and halftone patterns could be used for the control of toner dispenser system 61, electrostatic system 62, developer bias system 68, image exposure system 69 and image processing system 70.

Another printing process to control is the placement of the latent image on the photoreceptor. As taught in U.S. Pat. No. 5,291,245 discussed above, it is well known to use a sensor to detect the position of a belt seam on a photoconductive belt and to use this measurement to insure that latent images are exposed at generally the same position on the photoreceptor in each pass and that they do not overlap the seam of the belt. In the view shown in FIG. 2, photoreceptor belt 10 has a belt seam 11 and latent image area 13. The densitometer is located in close proximity to the belt and detects the belt seam in the first pass prior to the exposure of the first image to be developed and and in some cases each subsequent pass of the photoreceptor. The IRD generates an output signal representative of the seam detection to the controller. The controller then controls the imaging process so that the image is not formed on the belt seam.

Using a sensor to measure multiple image calibration is yet another use for the IRD. As described above in U.S. Ser. No. 08/451,609, a wide area beam sensor can be used for image registration calibration in a color printer. The densitometer of the present invention may also perform this image registration calibration function. In the registration process, sets of black registration marks S1, S2, S3, S4 and S5 are imaged and developed on the photoreceptor.

The ROS 26 exposes the photoreceptor to form the registration marks, a possibly unique set of registration marks being associated with black and at least one of the colors to be measured. In a subsequent pass of the photoreceptor, a set of color registration marks are imaged and developed on the black registration mark set. The system 50 reads each set of black and colored marks and this information is sent to the controller which accordingly controls the registration of each colored image with respect to the black image. In the five pass configuration, this IRD measurement of the registration marks 52 is capable of supplying the information to controller 60 which will enable the image placement system 63 to precisely place the image separations for the second, third and fourth colors in registration with the black image, which as described above, are placed in position according to the belt seam measurement.

Another desirable printing parameter to detect is the presence of a paper jam or fault. A transparent copysheet specularly reflects light and an opaque copysheet diffusely reflects light. Both of these types of copysheets 54 can be detected by the IRD, which passes this signal to the controller 60.

The transfer sheet 38 enters the photoreceptor area on the fifth cycle and at this time the readings from the densitometer should normally indicate a transfer sheet presence 54 which will have a different reflected light value than the photoreceptor. If a translucent or opaque transfer sheet is not detected in the fifth cycle, then a jam or fault has occurred between the paper feeder and the densitometer. The controller will receive the specularly or diffusely reflected measurements from the IRD and will control the printing process and timing based on the absence or presence of a transfer sheet in the final pass. The jam/fault system 65 will accordingly declare a paper jam or fault. Similarly the actual arrival and/or departure times of the sheet can be utilized by controller 60 to adjust the paper transport timing system 67 to achieve reliable and consistent paper passage.

The controller can also be programmed to detect a sheet which has not been properly removed from the photoreceptor after the last cycle. This is accomplished by having the IRD activated in a standby mode or during a machine cycle-in or cycle-out procedure. If the IRD value indicates that a transfer sheet is present in the first cycle then a paper fault is declared.

One more use of the sensor is that of discriminating between an opaque piece of paper and a transparency. It is known to use specular and diffuse reflection to discriminate between opaque and transparent copysheets as taught in U.S. Pat. Nos. 5,139,339 and 5,329,338. However, both of these patents use specialized detectors which are not located adjacent the photoreceptor. In the present invention, the same sensor which detects the diffuse and specular components of the light reflected from the photoreceptor area is used. The opaque copy sheet will reflect the light more diffusely than the transparent copy sheet which reflects light specularly. The discriminating use of the photodetector is used only in the last pass since this is the only pass where a copy sheet is supposed to be present. Depending upon the type of copysheet detected 55, the controller will accordingly control the fusing system 66 or other processes related to the copy sheet type.

In recapitulation, it has been shown that a single sensor can be used to measure multiple printing process parameters including the belt seam, the toner density, image registration marks, copysheet presence and timing, and copysheet types in a printing machine. These measurements are in turn used to control the printing process.

It is, therefore, apparent that there has been provided in accordance with the present invention, a multiple function sensor that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A method of sensing process parameters and controlling the printing process in a printing machine comprising:

passing a charge retentive surface through at least one revolution about the printing machine;

forming a latent image on the charge retentive surface during the revolution;

developing the latent image with toner;

transporting a transfer sheet along an operative paper path;

transferring the developed image to the transfer sheet;

fusing the transferred image to the transfer sheet;

locating an optoelectronic sensor in sensing relationship with the charge retentive surface and the operative paper path;

sensing a printing parameter with the optoelectronic sensor; and controlling the printing process based on the sensed printing parameter.

2. The method of sensing process parameters as claimed in claim 1, wherein the optoelectronic sensor is a densitometer.

3. The method of sensing process parameters as claimed in claim 1, wherein, said forming step includes forming a latent test image on the charge retentive surface;

said developing step includes developing the latent test image; and said sensing step includes sensing toner density of the test image.

4. The method of sensing process parameters as claimed in claim 3, wherein said controlling step includes controlling toner dispensing, electrostatics of the charge retentive surface, and developer biasing.

5. The method of sensing process parameters as claimed in claim 3, wherein said controlling step includes controlling an image exposure system.

6. The method of sensing process parameters as claimed in claim 3, wherein said controlling step includes controlling an image processing system.

7. The method of sensing process parameters as claimed in claim 3, wherein, said passing step includes passing the charge retentive surface through five revolutions;

said forming step includes forming four latent test images, each latent test image being associated with a different color;

said developing step includes developing each latent test image with a different color;

said sensing step includes sensing toner density of each of the developed test images; and said controlling step includes controlling toner dispensing, electrostatics of the charge retentive surface, developer biasing and image processing for each of the test images sensed.

8. The method of sensing process parameters as claimed in claim 1, wherein, said sensing step includes sensing a mark on the charge retentive surface; and said controlling step includes controlling placement of the latent image on the charge retentive surface.

9. The method of sensing process parameters as claimed in claim 1, wherein, said forming step includes forming a set of black and another color latent image registration marks on the charge retentive surface;

said developing step includes developing the set of black and another color latent image registration marks with black toner and another color toner;

said sensing step includes sensing the black and the another color registration marks; and said controlling step includes controlling image registration based on the sensed set of black and another color registration marks.

10. The method of sensing process parameters as claimed in claim 1, wherein, said sensing step includes sensing the presence of the transfer sheet on the charge retentive surface; and said controlling step includes controlling paper transport timing and a paper fault indicator based on the sensed presence of the transfer sheet.

11. The method of sensing process parameters as claimed in claim 1, wherein, said sensing step includes sensing the difference between an opaque transfer sheet and a transparent transfer sheet on the charge retentive surface; and said controlling means includes controlling fusing setpoints in the fusing step.

12. An apparatus for sensing process parameters and controlling the printing process in a printing machine comprising:

a charge retentive surface;

an operative paper path;

means for passing the charge retentive surface through at least one revolution about the printing machine;

means for forming a latent image on the charge retentive surface;

means for developing the latent image with toner;

means for moving a transfer sheet along the operative paper path into transferring relationship with the developed image on the charge retentive surface;

means for transferring the developed image to a transfer sheet;

means for fusing the transferred image to the transfer sheet;

an optoelectronic sensor for sensing a printing parameter located in sensing relationship with the charge retentive surface and the operative paper path; and a controller for controlling the printing process based on the sensed printing parameter.

13. The apparatus for sensing process parameters as claimed in claim 12, wherein said optoelectronic sensor is a densitometer.

14. The apparatus for sensing process parameters as claimed in claim 12, wherein said forming means forms a latent toner density test area image;

said developing means develops the latent toner density test area image with toner;

said optoelectronic sensor senses the developed toner density test area image; and said controller controls toner dispensing, electrostatics of the charge retentive surface, and developer biasing based on the sensed toner density test area image.

15. The apparatus for sensing process parameters as claimed in claim 12, wherein said forming means forms a latent toner density test area image;

said developing means develops the latent toner density test area image with toner;

said optoelectronic sensor senses the developed toner density test area image; and said controller controls image exposure on the charge retentive surface based on the sensed toner density test area image.

16. The apparatus for sensing process parameters as claimed in claim 12, wherein said forming means forms a latent toner density test area image;

said developing means develops the latent toner density test area image;

said optoelectronic sensor senses the developed toner density test area image; and said controller controls image processing based on the sensed toner density test area image.

17. The apparatus for sensing process parameters as claimed in claim 12, wherein said forming a latent image means forms a latent set of black registration marks and a latent set of another color registration marks;

said forming a developed image means develops the latent black set of registration marks and the latent another color set of registration marks;

said optoelectronic sensor senses the developed black set of registration marks and the developed another color set of registration marks;

and said controller controls image registration based on the sensed black set of registration marks and the sensed another color set of registration marks.

18. The apparatus for sensing process parameters as claimed in claim 12, wherein, said optoelectronic sensor senses transfer sheet presence; and said controller controls paper path timing based on the transfer sheet presence sensed by said sensing means.

19. The apparatus for sensing process parameters as claimed in claim 12, wherein, said optoelectronic sensor senses transfer sheet type; and said controller controls said fusing means based on the sensed transfer sheet type.

20. A printing machine including a charge retentive surface; image forming means for forming a latent image on the charge retentive surface; developing means for developing the latent image with toner; transfer means for transferring the developed toner image from the charge retentive surface to a support surface; and a control arrangement responsive to a printer parameter sensor for controlling operation of the printing machine, comprising:

a sensor, mounted in printer parameter sensing relationship to at least the charge retentive surface and a portion of an operative support surface transport path and sensing a plurality of printing parameters thereat; and means responsive to said sensor, controlling adjustment of a plurality of sensed printer parameters.

* * * * *